United States Patent [19]

van Nunen et al.

[11] 4,060,415

[45] Nov. 29, 1977

[54] ELECTROPHOTOGRAPHIC PROCESS

[75] Inventors: Petrus J. M. van Nunen, Reuver; Willem van Barneveld, Grubbenvorst, both of Netherlands

[73] Assignee: Océ-van der Grinten, N.V., Venlo, Netherlands

[21] Appl. No.: 366,845

[22] Filed: June 4, 1973

[30] Foreign Application Priority Data

June 7, 1972 Netherlands ..... 7207688

[51] Int. Cl.[2] ..... G03G 5/08

[52] U.S. Cl. ..... 96/1.8; 96/1.5 D; 252/62.1 P

[58] Field of Search ..... 96/1.8, 1.5 D; 252/62.1

[56] References Cited

U.S. PATENT DOCUMENTS

| | | | |
|---|---|---|---|
| 2,788,288 | 8/1957 | Rheinfrank et al. | 96/1.5 D |
| 3,278,439 | 10/1966 | Blanchett et al. | 252/62.1 |
| 3,391,082 | 7/1968 | Maclay | 96/1.5 D |
| 3,565,805 | 2/1971 | Jones et al. | 252/62.1 |
| 3,650,797 | 3/1972 | Tomanek | 96/1.5 D |
| 3,681,106 | 8/1972 | Burns et al. | 96/1.5 D |
| 3,725,061 | 4/1973 | Verhille et al. | 96/1.8 |
| 3,776,724 | 12/1973 | Usmani | 96/1.8 |
| 3,799,911 | 3/1974 | Dissen et al. | 96/1.8 |

*Primary Examiner*—Edward C. Kimlin
*Attorney, Agent, or Firm*—Albert C. Johnston

[57] ABSTRACT

Electrophotographic copies having images of high optical density formed on photoconductive layers having little weight and suitably transparent for use as photocopying originals are produced by charging electrostatically and exposing imagewise a photoconductive layer of less than 10 g/m$^2$ in dry weight and less than 6 microns in thickness which contains zinc oxide and a binder in a weight proportion of between 9 and 14 and is chargeable at most to a surface potential of between 100 and 250 V, this layer being carried on a conductive flexible support having a specific resistance of less than $10^{13}$ ohm. cm, and thereafter developing the resulting charge pattern by contacting it during at most 3 seconds with a "one-component" powder which contains pigment dispersed in resin and has a specific resistance below $10^7$ ohm. cm, while maintaining a conductive connection between the developing powder and said support.

14 Claims, No Drawings

ELECTROPHOTOGRAPHIC PROCESS

The present invention relates to an electrophotographic process for the formation of visible images, of the kind in which a charge pattern constituting a latent image is formed in a photoconductive layer on a flexible support and this charge pattern is developed with a developing powder.

In electrophotographic copying processes so-called photoconductive layers are used in which a charge pattern is formed, usually by charging the layer electrostatically in the dark and subsequently exposing it imagewise. The latent image of the charge pattern is developed (made visible) by bringing it close to or in contact with colored particles which are attracted and retained by the electrostatic charges of the charge pattern. The developed image is fixed, for instance by heating it or by bringing it into solvent vapors which make the toner particles and/or the surface of the photoconductive layer gluey, or it is transferred from the surface of the photoconductive layer to a receiving material and is subsequently fixed on the receiving material.

The photoconductive layer in which the charge pattern is formed may consist of a film-forming insulating binder, or a mixture of such binders, in which an organic or inorganic photoconductive compound, for instance zinc oxide or selenium, is finely dispersed, or of an organic film-forming photoconductive polymer, for instance polyvinyl carbazole, which may be mixed with a non-photoconductive binder, or of an inorganic photoconductive compound, for instance selenium, that has been evaporated and deposited in vacuo.

In direct electrophotography, by which is meant processes wherein the image is fixed on the photoconductive layer, the copying material generally used consists of a flexible support that is conductive or made conductive, usually paper, on which is applied a photoconductive layer containing one or more insulating film-forming binders and a photoconductive compound. Usually the photoconductive layer also contains activators and sensitizers for the photoconductive compound.

Before the formation of the charge pattern the photoconductive layer of the copying material is charged electrostatically, for instance in a corona discharging device. Then it is exposed imagewise. The imagewise exposure of the electrostatically charged photoconductive layer is preferably effected by an episcopic exposure system, wherein the original to be copied is irradiated with actinic radiation and the radiation reflected by the original is directed toward the photoconductive layer via an optic system. An advantage of episcopic exposure, compared with contact exposure, is that all kinds of originals can be copied if their image parts have a reasonable absorption for actinic radiation. With contact exposure only light pervious originals can be copied.

Two methods for the development of the charge pattern formed in the photoconductive layer have found practical application in direct electrophotography: the liquid development method and the magnetic brush development method.

In the liquid development method the charge pattern is made visible by applying to the image bearing surface a developing liquid which consists of an insulating organic liquid, usually kerosene, having dispersed therein very fine colored insulating particles carrying a charge having a polarity opposite to that of the charge pattern.

This liquid development method is disadvantageous in that a liquid developer must be used which contains an inflammable organic solvent having a distinct odor, and in that the image parts of the copies obtained have a rather low optical density while the background parts usually have a slightly gray tone. The optical density of the image parts of the copies is rarely higher than 1 and usually lies between 0.7 and 0.9. The slightly gray tone on the copies occurs because fine toner particles from the liquid developer deposit to a slight extent on the exposed parts of the photoconductive layer.

In the magnetic brush development method the charge pattern is developed by means of a developer in powder form. This developer consists principally of a mixture of relatively coarse, magnetically attractable carrier granules, usually iron particles, and much smaller insulating toner particles which contain thermoplastic resin and pigment, for instance carbon. The toner particles are in a triboelectric relation to the carrier granules such that upon triboelectric contact with them they accept an electrostatic charge having a polarity opposite to that of the charge pattern to be developed. The developing powder is carried to the charge pattern by means of a magnet which attracts the carrier granules by magnetic forces so that they form as it were a brush to which the toner particles are attached by electrostatic forces.

The copies obtainable with magnetic brush development usually are of better quality than those obtained with liquid development. Magnetic brush development enables the production of copies with image parts having an optical density considerably higher than 1, and with background parts almost free of toner particles.

The quality of the copies obtained in direct electrophotography is, however, not dependent only on the developing method used. Many other factors also play a part. It is clear, for instance, that the composition of the liquid or powder developer and the time of development also influence the copy quality. Further, the copy quality is affected by the composition of the copying material and the potential of the charge pattern that is to be developed. The preparation of the copying material thus must be adapted not only for the requirements with regard to light sensitivity but also for the requirements with regard to copy quality.

Whether magnetic brush development or liquid development is to be used, it is generally necessary that the charge pattern have a potential of at least 200 – 250 V, in order to obtain copies with sufficient contrast. Since the photoconductive layer always undergoes some discharging in the dark, and since the image parts are struck by a certain amount of light during the imagewise exposure of the layer, due among other things to light being scattered in the optical system, it is necessary that the photoconductive layer possess the capacity to be charged to a potential considerably greater than 250 V.

The copying materials known for direct electrophotography which meet the practical requirements with regard to light sensitivity and copy quality, and which can be developed fast enough (within not more than a few seconds) by the known liquid or powder developers, have been produced by applying onto a relatively conductive support, such as paper that has been made conductive, a photoconductive zinc oxide-binder layer that can be charged to 400 V or more, having a thickness of 10 – 20 microns and containing zinc oxide and an insulating binder in a weight proportion of between 5 and 8.

Since the photoconductive layer of such copying materials is rather thick and its zinc oxide content, the most important component, has a high specific gravity, these known copying materials are quite heavy. Consequently, the copies obtained are not very desirable for storage in files. Another disadvantage of these materials is that the thick photoconductive layer is so slightly pervious to actinic radiation that the copies obtained are hardly suitable for further copying by contact exposure, even if the photoconductive layer is applied on a transparent support.

It has been proposed heretofore to overcome these disadvantages by reducing the thickness of the photoconductive zinc oxide-binder layer to the range of 5 to 10 microns. Ways proposed for doing this include, for instance, using special binders, using especially processed zinc oxide or a mixture of zinc oxides having different particle sizes, incorporating inert pigments, for instance silica, into the photoconductive layer, and increasing to 10 or higher the weight proportion of zinc oxide to insulating binder. These proposals, however, have resulted in copying materials the photoconductive layer of which could not be charged to a potential higher than 250 – 300 V, with the consequence that upon imagewise episcopic exposure and with the development methods usually employed for direct electrophotography the copies obtained were of unsatisfactory quality.

An important need exists in electrophotography for a process capable of producing copies of good quality by developing within at most a few seconds a charge pattern formed by imagewise episcopic exposure of a photoconductive layer that can be charged to a surface potential of at most 250 V. This would make it possible to produce copies at the required rate with the use of copying materials having a photoconductive layer of only a few microns in thickness. The copies thus would have a considerably reduced weight and also, when the support is transparent, would be sufficiently pervious to actinic radiation to enable satisfactory use of them as originals for further copying as by contact exposure.

The object of the present invention is to provide such a copying process.

According to this invention, a latent charge pattern is formed in a photoconductive zinc oxide-binder layer by charging the layer electrostatically and exposing it imagewise, said layer containing zinc oxide and a binder in a weight proportion of between 9 and 14 and being chargeable at most to a surface potential of between 100 and 250 V and being present on a flexible support having a specific resistance of less than $10^{13}$ ohm. cm, and subsequently developing the charge pattern thus obtained so as to make it visible by contacting it during not more than 3 seconds with a quantity of one-component powder having a specific resistance below $10^7$ ohm. cm while maintaining a conductive connection between the developing powder and the support of the photoconductive layer.

It has been found, surprisingly, that by the use of a relatively conductive developing powder having a specific resistance below $10^7$ ohm. cm for the development of a charge pattern charged to a low potential, copies are obtained which have a considerably better quality than the copies which are obtained by developing such a charge pattern either according to the magnetic brush method with the use of a two-component powder consisting of conductive, magnetically attractable carrier granules and insulating toner particles, or according to the liquid method with the use of a liquid developer consisting of a fine dispersion of toner particles in an insulating liquid.

During the development of the charge pattern in the present process a conductive connection must be maintained between the powder particles which are brought into contact with the charge pattern and the support carrying the photoconductive layer bearing the charge pattern. This connection can easily be obtained by leading the copying material bearing the charge pattern to be developed through a reservoir filled with the one-component powder.

However, it is also possible to develop the latent image by bringing the conductive one-component powder into contact with the charge pattern by means of a conductive applicator connected conductively to the rear of the support of the photoconductive layer. The conductive connection between the applicator and the rear of the support may be provided, for instance, by electrically grounding them. The conductive applicator may be, for instance, a conductive magnetic roller of the type used in conventional magnetic brush development of charge patterns, in which case the conductive one-component powder used is one which is also magnetically attractable.

In order to determine that a photoconductive zinc oxide-binder layer to be used according to the invention can be charged at most to a surface potential between 100 and 250 V, the charging capacity of the photoconductive layer may be measured by means of a static measurement in the Victoreen Electrostatic Paper Analyzer.

The low-charging photoconductive zinc oxide-binder layers used according to the invention have a considerably lower weight and a considerably smaller layer thickness than the photoconductive layers of the copying materials generally used heretofore. Their dry weight amounts to less than 10 g/m² and their layer thickness to less than 6 microns, whereas the layers generally used heretofore have a dry weight of 17 g/m² or higher and a layer thickness of more than 10 microns. Moreover, the photoconductive layer of the copying materials used according to the invention has a greater transparency than the photoconductive layer of the known materials, so that with equal transparency of the supports the copies made on these materials serve considerably better as intermediate originals for further copying than do the copies made on the known materials.

The photoconductive layer contains as its essential ingredients zinc oxide and a binder in a weight ratio of Zno: binder which lies between 9 and 14 to 1 and preferably amounts to about 10 to 1. By the present process copies of better quality are obtained on these photoconductive layers than on corresponding layers in which the weight ratio of zinc oxide to binder lies between 5 and 8 to 1. Moreover, these layers have a higher light sensibility than the last-mentioned layers.

The photoconductive layer may contain as the binder any of the film-forming insulating binders which are known to be useful in photoconductive layers, such, for example, as polyvinyl acetate, polyvinyl chloride, polystyrene, polyacrylates, poly methacrylates, and copolymers of styrene with an acrylate or a methacrylate.

The photoconductive layer may also contain one or more of the activators and sensitizers usually employed in zinc oxide-binder layers. Suitable sensitizers, among others, are: bengal rose, naphthalene green, fluorescein, auramine, and astrazon blue.

A photoconductive layer which is very effective for carrying out the invention has a layer weight of 6 - 8 $g/m^2$ and contains as the binder a mixture of polyvinyl acetate and a copolymer of styrene with ethylacrylate, in which zinc oxide is dispersed at a weight ratio of 10 parts of zinc oxide to 1 part of the total binder. This layer can be charged at most to a surface potential of 150 - 200 V. It has a very good transmission for actinic radiation, so that the copies made with it can very satisfactorily be used as intermediate originals for further copying, for instance on diazotype material, when their support is sufficiently transparent.

The imagewise exposure of the electrostatically charged photoconductive layer is preferably effected in an episcopic exposure system, but it can also be effected by contact exposure if the original is transparent.

The support for the photoconductive layer can be made of materials known for use in the manufacture of copying materials for direct electrophotography. These support materials usually consist of paper having a relatively low specific resistance of $10^8$ to $10^{10}$ ohm. cm, due, for instance, to electrolytes or conductive pigments such as carbon having been incorporated in them, or of paper that has been provided with a conductive surface layer. Such support papers are also usually provided with a coating which is impermeable to the solvent used in the composition from which the photoconductive layer is formed.

It has been found, however, that the support of the copying materials for use according to the invention need not be as conductive as the supports of the known copying materials. Good results are also obtained when the support has a resistance of $10^{10}$ - $10^{13}$ ohm. cm, especially if the one-component powder used for the development of the charge pattern is one having a specific resistance of between $10^2$ and $10^5$ ohm. cm. The support used for the photoconductive layer preferably is a paper having a weight of 40 - 75 $g/m^2$ and having a specific resistance of less than $10^{12}$ ohm. cm. When such paper is used as the support for the low-charging photoconductive layer and development is effected by a one-component powder having a specific resistance below $10^5$ ohm. cm, it is possible according to the invention to obtain copies of excellent quality at developing times of less than 1.5 seconds. Thus a quickly working copying process yielding 30 or more copies per minute can be realized.

If the copies to be produced are to be used as intermediate originals for further copying by contact exposure, the support of the copying material must of course be transparent. Transparent paper complying with the above specifications is then preferably used as the support. However, superficially saponified cellulose acetate film can also be used as a transparent support.

The conductive one-component powder to be used for the development of the charge pattern must have a specific resistance below $10^7$ ohm. cm, as measured according to the methods described in Example 1 of a copending United States patent application, Ser. No. 340,828, assigned to the assignee of the present application. The powder preferably has a specific resistance between $10^2$ and $10^5$ ohm. cm. With such well-conductive powders good copies the images of which have an optical density of more than 1.2 can be obtained at the very short developing time of not more than 3 seconds, even under unfavorable circumstances such as at a relative humidity of less than 30% and when using copying material having a relatively insulating support, for instance, one having a specific resistance of $10^{10}$ - $10^{13}$ ohm. cm. The one-component powder preferably is one containing a thermoplastic resin, in which case the images made with it can be fixed by heating.

Suitable developing powders can be obtained by homogeneously dispersing a sufficient quantity of conductive pigment, for instance 25 - 50 percent by weight of carbon or other conductive material, in a melt of a thermoplastic resin, allowing the melt to cool down to a solid mass, and finely grinding the solid mass. Suitable developing powders can also be obtained by depositing conductive material, such as carbon, on the surface of thermoplastic resin particles. Suitable one-component powders and methods for their manufacture are described in the aforesaid copending application. In making a one-component powder of the kind described in that application the magnetic material can of course be left out if the powder is to be applied to the charge pattern without use of a magnetic applicator. The particle size of the one-component powder preferably lies between 10 and 40 microns.

EXAMPLE I

A sheet of glassine paper weighing 50 $g/m^2$ and having a specific resistance of $10^{11}$ - $10^{12}$ ohm. cm is provided with a photoconductive layer by applying the following coating liquid:

100 g of photoconductive zinc oxide having a specific surface area of 7 - 8 $m^2/g$, 19 g of a 46% by weight solution of polyvinyl acetate and a copolymer of styrene and ethyl acrylate in a mixture of propanol, toluene and xylene, 120 g of toluene, and 50 mg of a solution of 1.7 g of rose bengal, 3.3 g of fluorescein, 1.7 g of naphthalene green, 1.3 g of auramine 0 and 2.1 g of astrazon blue in 1,000 ml of methanol.

The photoconductive layer has a dry weight of 7 $g/m^2$. Its maximum charging capacity is about −180 V, as measured in the Victoreen Electrostatic Paper Analyzer.

The photoconductive layer of the copying material thus obtained is charged to a potential of −180 V by a known corona discharging device and is subsequently exposed imagewise by episcopic exposure. The charge pattern resulting is developed by passing the material through a reservoir filled with a one-component powder prepared according to example I of said copending patent application Ser. No. 340,828. The developing time amounts to less than 1.5 seconds. The excess of one-component powder present on the copy is removed by knocking against the copy, and finally the image is fixed by heating.

The copy shows a strongly black image on a clear background. The optical density of its image parts lies between 1.4 and 1.6. The image-free parts have a good transmission for actinic radiation, so that the copy can be used effectively as an intermediate original for further copying, for instance on diazotype material, by contact exposure.

EXAMPLE II

The same support as used in Example I was provided with a photoconductive layer by applying to it a liquid of the following composition:

100 g of photoconductive zinc oxide having a specific surface of 4 $m^2/g$, 17 g of a 59% by weight solution of a copolymer of butylacrylate and styrene in a mixture of 7 parts by volume of xylene and 3 parts by volume of butanol, 115 g of toluene, and 30 mg of a solution of 2.3 g of rose bengal, 4.6 g of fluorescein and 3.7 g of naphthalene green in 1,000 ml of methanol.

The photoconductive layer has a dry weight of 5 $g/m^2$. Its maximum charging capacity amounts to about −100 V. In the photoconductive layer of the copying material thus obtained a latent charge pattern is formed in the way as described in Example I.

The charge pattern is developed by means of a one-component powder prepared according to Example II of the aforesaid copending patent application. The power is brought into contact with the surface bearing the charge pattern by means of a hollow copper cylinder inside of which permanent magnets are installed. The image is fixed by heating.

A copy having a strongly black image on a clear background is obtained. The optical density of the image parts amounts to 1.3 – 1.4. The copy can be used effectively as an intermediate original for further copying.

EXAMPLE III

A base paper for electrophotography weighing about 70 $g/m^2$ and having a specific resistance of $10^9$ ohm. cm is provided with a photoconductive layer having a dry weight of about 5 $g/m^2$ by applying to it the coating liquid described in Example I. The maximum charging capacity of this photoconductive layer amounts to about −110 V. A charge pattern is formed in the photoconductive layer of the copying material thus obtained in the manner described in Example I. The charge pattern is developed and fixed as described in Example I, excepting that the one-component powder used is one having a specific resistance of $10^6$ ohm. cm and which consists of fine particles of epoxy resin having a softening point of about 90° C. and having fine carbon particles deposited on their surface, the particle sizes of this powder being in the range between 10 and 40 microns.

A strongly black copy is obtained, the image parts of which have an optical density of about 1.3.

We claim:

1. An electrophotographic process which comprises charging electrostatically and thereafter exposing imagewise a photoconductive layer of less than 6 microns in thickness containing zinc oxide and a binder in a weight ratio ZnO:binder of between 9 and 14 to 1 and which layer is chargeable at most to a surface potential between 100 and 250 V, said layer being present on a flexible support having a specific resistance of less than $10^{13}$ ohm. cm, and developing the charge pattern resulting on said layer so as to render it visible by contacting it during not more than 3 seconds with one-component developing powder of a mass thereof the particles of which are of substantially the same composition and predominantly comprise resin and finely divided relatively conductive material, and which has a specific resistance below $10^7$ ohm. cm, while maintaining a connection for charge conductance, at least in part through said mass, between said powder and said support.

2. A process according to claim 1, said layer being of less than 10 $g/m^2$ in dry weight.

3. A process according to claim 1, said developing and said connection being effected by passing said support with said layer thereon through a reservoir filled with said powder mass.

4. A process according to claim 1, the ratio of zinc oxide to binder in said layer amounting to about 10 to 1.

5. A process according to claim 1, said binder consisting principally of a mixture of polyvinyl acetate and a copolymer of styrene and ethyl acrylate.

6. A process according to claim 1, said exposing being effected episcopically.

7. A process according to claim 1, said support being paper weighing 40 – 75 $g/m^2$ and having a specific resistance of less than $10^{12}$ ohm. cm.

8. A process according to claim 1, said support being a material transparent to actinic light which has a dry weight of 40 to 75 $g/m^2$ and a specific resistance of less than $10^{12}$ ohm. cm.

9. A process according to claim 1, said developing powder having a specific resistance of between $10^2$ and $10^5$ ohm. cm.

10. A process according to claim 1, the particles of said developing powder each comprising a major proportion of thermoplastic resin and a minor proportion of finely divided relatively conductive material and their sizes being between 10 and 40 microns.

11. An electrophotographic process which comprises charging electrostatically to a surface potential of between 100 and 200 V and thereafter exposing imagewise a photoconductive layer consisting essentially of zinc oxide and a binder in a weight ratio ZnO:binder of between 9 and 14 to 1, said layer being of less than 8 $g/m^2$ in dry weight and less than 6 microns in thickness and being present on a flexible support that is transparent to actinic light and has a dry weight of 40 to 75 $g/m^2$ and has a specific resistance of less than $10^{12}$ ohm. cm, and developing the resulting charge pattern so as to render it visible by contacting said layer with one-component developing powder of a mass thereof the particles of which are of substantially the same composition and of between 10 and 40 microns in size and predominantly comprise resin and finely divided relatively conductive material, and which has a specific resistance of between $10^2$ and $10^5$ ohm. cm, while maintaining a connection for charge conductance, at least in part through said mass, between said powder and said support.

12. A process according to claim 11, said binder consisting principally of a mixture of polyvinyl acetate and a copolymer of styrene and ethyl acrylate, and the particles of said developing powder each comprising pigment dispersed in thermoplastic resin.

13. An electrophotographic copy comprising a flexible support which is transparent to actinic light and has a dry weight of 40 to 75 $g/m^2$ and a specific resistance of less than $10^{12}$ ohm. cm., on said support a photoconductive layer consisting essentially of zinc oxide and a binder in a weight ratio ZnO:binder of between 9 and 14 to 1 and which is chargeable at most to a surface potential between 100 and 200 V, said layer being of less than 8 $g/m^2$ in dry weight and less than 6 microns in thickness, and on said layer an electrostatically formed image composed of a developing powder the particles of which are of substantially the same composition and of between 10 and 40 microns in size and predominantly comprise resin and finely divided relatively conductive material, and which has a specific resistance of between $10^2$ and $10^5$ ohm. cm.

14. An electrophotographic copy according to claim 13, said binder consisting principally of a mixture of polyvinyl acetate and a copolymer of styrene and ethyl acrylate, and said particles of said developing powder each comprising pigment dispersed in thermoplastic resin.

* * * * *